United States Patent [19]

Small

[11] Patent Number: 4,917,051

[45] Date of Patent: Apr. 17, 1990

[54] FLOATING NEEDLE SEWING MACHINE FOR SIMULATING HAND STITCHING

[75] Inventor: Mason S. Small, Leeds, Great Britain

[73] Assignee: Automated Machinery Systems, Inc., Richmond, Va.

[21] Appl. No.: 319,158

[22] Filed: Mar. 6, 1989

[30] Foreign Application Priority Data

Mar. 16, 1988 [GB] United Kingdom ..... 8806236

[51] Int. Cl.[4] ..... D05B 23/00; D05B 65/00

[52] U.S. Cl. ..... 112/171; 112/285

[58] Field of Search ..... 112/171, 285, 170

[56] References Cited

U.S. PATENT DOCUMENTS 3,125,046 3/1964 Pedersen ..... 112/171 X 4,248,165 2/1981 Addy et al. ..... 112/171 X

*Primary Examiner*—Andrew M. Falik

*Attorney, Agent, or Firm*—Bacon & Thomas

[57] ABSTRACT

A sewing machine capable of simulating hand stitching. The machine comprises a throat plate (101), a needle passage region (104) through the throat plate, a needle (2), upper and lower needle holders (4, 5) for driving the needle between a raised position lying wholly above the throat plate and a lowered position lying wholly below the throat plate, and thread-control drum and looper (9, 11) lying below the throat plate. A thread-guide tube (26) is located above the throat plate for guiding supplied thread so that a section thereof lies in a first thread path. A first clamp (33, 34) is operable to releasably clamp the thread adjacent to a free end thereof when lying in said first thread path. A thread pick-up (42) is movable from a retracted position to an advanced, thread pick-up position, the pick-up being cooperable with the raised needle so that during movement back to the retracted position the picked up thread engages and is held by the raised needle and part of the thread is caused to lie in a second thread path extending from the raised needle to the retracted pick-up. Second clamp jaws (46, 47) are operable to releasably clamp thread lying in the second thread path.

10 Claims, 5 Drawing Sheets

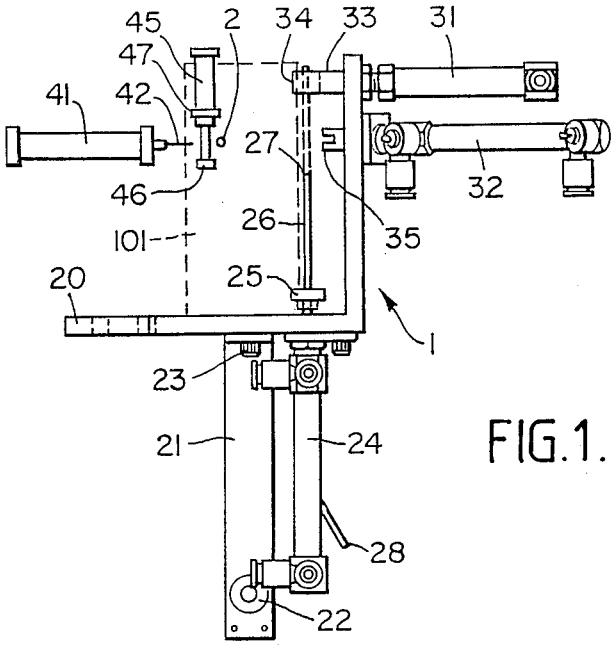
FIG.1.
FIG.2.
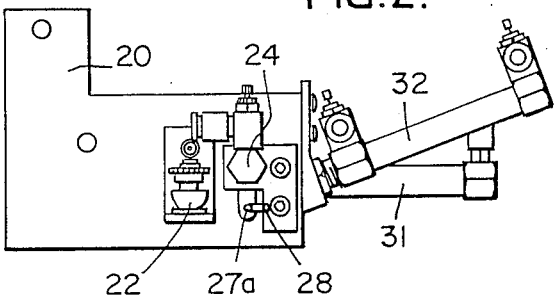

FLOATING NEEDLE SEWING MACHINE FOR SIMULATING HAND STITCHING

BACKGROUND OF THE INVENTION

This invention relates to a sewing machine, and particularly to the type of industrial sewing machine that is capable of simulating hand stitching.

In such machines, movements of the needle and the workpiece are synchronized in such a way that the thread forms a first stitch lying above the workpiece, passes downwardly through the workpiece, forms a second stitch lying below the workpiece and then passes upwardly through the workpiece. The cycle is repeated to form a continuous line of stitching.

There are principally two types of machine that can operate in this way, the floating needle type and the latched needle type.

Floating needle machines utilize a needle having pointed upper and lower ends and an eye in a central region of the needle. An upper releasable needle holder is mounted for reciprocation above the throat plate of the machine and is capable of gripping the upper end of the needle. Similarly, a lower releasable needle holder is mounted for reciprocation below the throat plate and is capable of gripping the lower end of the needle. Means are provided for controlling the needle holder so that the needle is transferred from the grip of the upper needle holder to the grip of the lower needle holder as the needle moves downwardly from an upper position lying wholly above the throat plate to a lower position lying wholly below the throat plate. Similarly, the needle is transferred from the grip of the lower needle holder to that of the upper needle holder as the needle moves upwardly from the lower position to the upper position. Floating needle machines have a drum mounted below the work table of the machines, the drum having a periphery around which a length of thread may be wrapped by a looper mounted for rotation around the periphery of the drum.

Latched needle machines utilize a needle having a point on the lower end only, the thread being retained on the needle by a latch which is released after the needle has moved downwardly through the workpiece. The needle is then moved upwardly before further movement of the workpiece to release the thread below the workpiece. The workpiece is advanced, the needle moved downwardly and the thread is picked up and held on the needle by the latch. The needle moves upwardly to draw thread back above the workpiece, which is then advanced and the cycle repeated. Such machines again have a drum below the work table, the drum having a periphery around which a length of thread may be wrapped.

These known machines utilize pre-cut lengths of thread, provided to the machine operator in the form of a package. The package is usually suspended or otherwise held in a convenient location adjacent to the machine, and the operator takes single lengths of thread from the package as required, threads the needle of the machine and operates the looper so that the remainder of the length of thread is drawn into position around the periphery of the drum. As stitching proceeds, the looper rotates about the drum in synchronization with the needle, in order to draw free thread off the drum as required and then to place the free thread back into the drum.

Significant time and cost are involved in preparing the packets of pre-cut thread. Selection of individual thread lengths from the packet is not always easy, and requires the machine to be stopped while the operator performs this function. The invention seeks to overcome this problem.

SUMMARY OF THE INVENTION

According to the present invention a sewing machine capable of simulating hand stitching further comprises a throat plate, a needle passage region through the throat plate, a needle, means for driving the needle between a raised position lying wholly above the throat plate and a lowered position lying wholly below the throat plate, and thread-control means lying below the throat plate, and including, above the throat plate, thread-guide means for guiding supplied thread so that a section thereof lies in a first thread path, first clamp means operable to releasably clamp the thread adjacent to a free end thereof when lying in said first thread path, thread pick-up means, first drive means for moving the pick-up means from a retracted position to an advanced, thread pick-up position, the pickup means being cooperable with the raised needle so that during movement back to the retracted position, the picked up thread engages and is held by the raised needle and part of the thread is caused to lie in a second thread path extending from the raised needle to the retracted pick-up means, and second clamp means operable to releasably clamp thread lying in the second thread path.

The invention makes possible the use of packages of continuous thread, rather than packets of pre-cut thread. It also extends the automation of the overall systeem and can lead to very significant cost and time savings. When initially preparing the machine for operation the operator loads the thread so that it extends from the package to the thrad guide means with he free end of the thread lying in the first thread path. he free end of the thread is then clamped by the first clamp means, and the thread pick-up means is advanced and reracted and the thread is engaged with thee raised needle. The second clamp means then operates to hold the hread in the needle engaged position. The thread has thus been automatically engaged with the needle.

When the needle has an eye, as is the case with a floating needle machine and may be considered so in the case of a latched needle machine, then the thread pick-up means is preferably a hook, the first drive means comprises means for driving the hook from the retracted position through the eye of the needle to the advanced position, and means are provided for engaging the thread with the hook when the hook is in or about its advanced position.

After the thread is engaged, the needle of a floating needle machine is moved to its lower position to draw thread from the package and pass it through the workpiece. When the needle reaches its lowered position the looper is operated to draw further thread from the package and wrap this around the periphery of the drum, the free end of the thread still being held by the second clamp means. When the looper has passed around the drum through an angle corresponding to the required length of thread, the thread supplied from the package is cut, and the looper continues rotating to place the whole of the cut length of thread around the drum periphery. Sewing can now commence in the conventional manner of operation of the machine. Analogous operation occurs in a latched needle machine.

There are many different ways in which the thread can be engaged with the hook when the hook is in or about its advanced position. These may include arrangement of the thread path and the path of movement of the hook such that the necessary engagement occurs due simply to hook movement. However, there may be difficulty in allowing the hook sufficient movement, and it is more preferred if means are provided for engaging the thread with the hook when the hook is in or about the advanced position. Such means may desirably comprise thread-pushing means and second drive means for moving the thread-pushing means between a retracted position and an advanced position, movement to the advanced position being across the first thread path to pick up thread and move it to a position engaged with the hook.

The first and second clamp means, the first drive means and the second drive means if provided are conveniently all actuated by pneumatic rams.

Preferably the second clamp means comprises first and second jaws and third drive means for moving the first jaw across the second thread path from an open position to a closed position, such movement being effective to clamp the thread and to release the thread from the pick-up means.

The thread guide means preferably includes a straight guide tube extending towards the first clamp means, and means for blowing air through the tube so that an end section of thread passing through the tube is directed by the air stream to the region of the first clamp means. The ideal is for the air stream actually to direct the thread between jaws of the first clamp means, and this is usually not difficult with relatively flexible threads. It may, however, be more difficult with stiff threads, and preferably fourth drive means are provided, again conveniently in the form of a pneumatic ram, for advancing the tube into jaws of the first clamp means and retracting it from those jaws. This movement of the tube will ensure that thread is located between the jaws for later clamping.

Although the thread may simply be cut manually after the looper has drawn a sufficient quantity from the package, it is preferable if thread cutting means operates automatically in synchronism with the other parts of the machine. The cutting means is then desirably carried by a presser foot located above the throat plate of the machine and having a needle passage opening therethrough. The cutting means may be a blade movable on the presser foot, for example by a further pneumatic ram, across the needle passage opening, and desirably beneath a co-operating transverse blade in order to provide a clean cut.

BRIEF DESCRIPTION OF THE DRAWINGS

The machine according to the invention will be better understood from the following description of a specific embodiment thereof, given in conjunction with the accompanying drawings in which:

FIGS. 1 to 3 are respectively a plan view, end elevations and side elevation of relevant components in the needle area of a sewing machine;

DESCRIPITON OF THE PREFERRED EMBODIMENT

Figure 3:
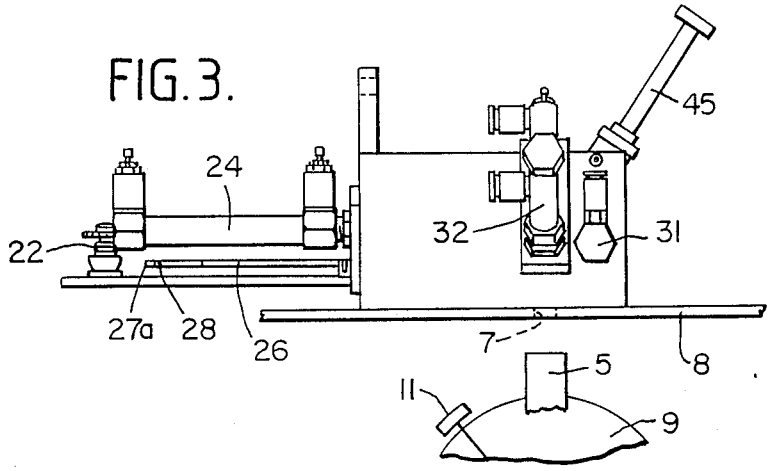
Figure 13:
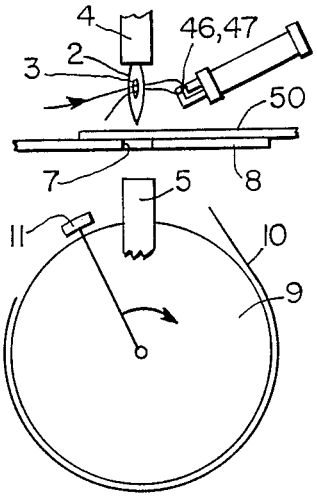
FIGS. 13 to 18 are sequence diagrams of the looper and stitching operation, with FIGS. 12 and 13 corresponding in time.

Referring now to FIGS. 1 to 3 these show the general assembly of a thread aligner and needle threading unit 1, in relation to the sewing machine needle 2 and presser foot 101 shown in broken outline in FIG. 1. As shown in FIG. 13, the needle 2 has pointed upper and lower ends together with a central eye 3, and it is exchangeable between upper and lower needle holders 4 and 5 as it is reciprocated by those needle holders through a slot in the presser foot and a needle passage slot 7 in the throat plate 8 of the machine.

Mounted below the throat plate is a drum 9 having a resilient retaining band 10 extending around part of its periphery and biased into engagement with the periphery. A thread looper 11 is arranged to rotate around the periphery of the drum, between the drum and the band as will be further explained later in the description, and as is well known in the type of machine to which the invention relates.

The thread aligner comprises a support 20 suitably attached to the sewing machine. The aligner includes an arm 21 carrying a thread tensioner 22 at a free end thereof, and secured by a screw 23 to the support 20. A pneumatic ram 24 is secured to the mount 20 adjacent to the arm 21, the piston rod of the ram extending through the mount and carrying a block 25 through which passes a hollow tube 26 having forward and rear ends 27 (FIG. 1), **27*a* (FIG. 3) and an angled rearward branch 28 adjacent to the thread tensioner 22. Thread taken from a package by way of the tensioner can be threaded through the tube from end 27*a* to end 27, and an air supply tube can be secured to branch 28. The tube 26 is shown with the ram 24 in its retracted position, but it can be extended to the position shown in dotted lines in FIG. 1**.

The mount 20 carries two further pneumatic rams 31 and 32. The first of these has a piston rod carrying a clamping block 33 capable of moving into engagement with a further clamping block 34 when the ram is extended from the position shown in FIG. 1. The second ram 32 has a piston rod carrying a thread pusher fork 35 capable of moving across a line continuing the axis of the tube 26 when the ram 32 is extended from the position shown in FIG. 1.

Mounted on the machine behind the needle is a further ram 41, the piston rod of which carries a hook 42 of a size such as to allow the hook to pass through the eye of the needle, when the needle is in a raised position and when the piston rod of ram 41 is moved between its extended and retracted conditions. When in the extended position the hook lies in a position adjacent to the position of the thread pushing fork 35 when this is in the extended position. A second clamp is also carried by the machine in the needle region, the clamp comprising a further pneumatic ram 45 having a piston rod carrying a movable jaw 46, capable of moving into engagement with a fixed jaw 47 on retraction of the ram. The movable jaw can move across a line joining the eye of the needle in the raised position and the retracted position of the hook.

Figure 4:
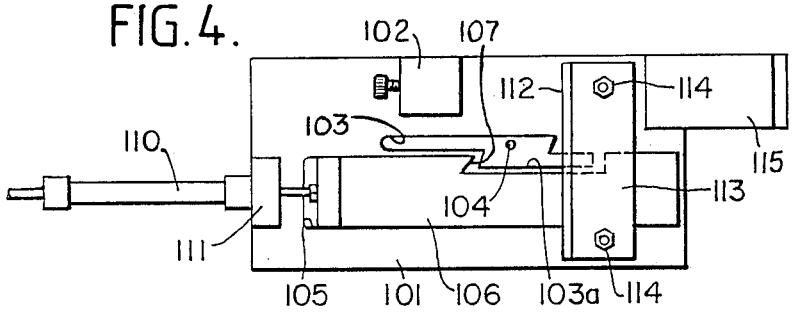
FIGS. 4 to 6 are respectively plan, side and end elevations of a presser foot incorporated in the machine of FIGS. 1 to 3.
Figure 5:
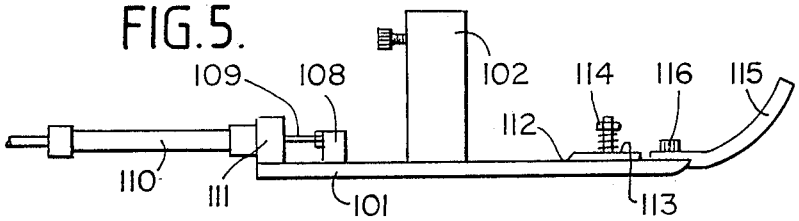
Figure 6:
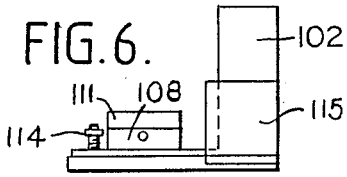

Referring now to FIGS. 4 to 6 the presser foot of the machine incorporates a footplate 101 secured to the lower end of a carrier 102 fixed to the presser foot operating mechanism of the machine. The footplate has a needle slot in the form of two interconnecting elongate sections 103 and 103*a*. The needle position is shown at 104. A recess 105 in the footplate slidably houses a blade 106 having a cut-out with a surface 107 formed as a knife edge. The blade is secured by a mount 108 to the end of a piston rod 109 of a pneumatic ram 110, secured by mounting block 111 to the footplate 101. The knife edge can slide over the slot section 103*a* and cooperates with a further knife edge 112 on a bridge 113 secured by nuts and studs 114 to the footplate. An upwardly curved workpiece guide member 115 is secured to the footplate by bolts 116.

Operation of the machine will now be described with reference to FIGS. 4 and 7 to 18. The starting position of the presser foot, of the parts of the needle threader and of the looper are shown respectively in FIGS. 4, 7 and 12. Referring to these Figures, in the start position the needle 2 is lies in its upper position and is gripped by the upper needle holder 4. The means by which the needle is gripped by the needle holder forms no part of the invention, and the manner of such gripping is well known to those of ordinary skill in the art. The tube 26 of the thread aligner is in its retracted position and a current of air blows thread passing through the tube to hold this in a position where it is directed towards or passes through the jaws 33, 34 of the first thread clamp. The hook 42 is in its retracted position, and the thread pusher 35 is also in its retracted position. The second thread clamp 46, 47 is in its advanced and open position. The upper 11 is at its start position relative to the drum 9, and the resilient retaining band lies in contact with the drum surface.

The operations to be described may either be under manual control of a machine operator, or more usually will operate in a first automatically controlled sequence for the needle threading operations and then in a further automatically controlled sequence for the looper operation. The automatic control may be effected by any suitable controller, and the principles of such control are well known in the art.

Figure 7:
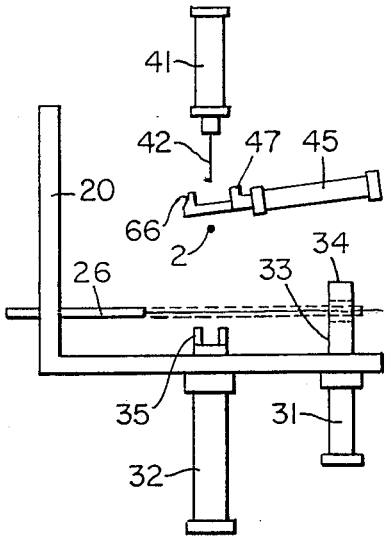
FIGS. 7 to 12 are sequence diagrams of the needle threading operation.
Figure 8:
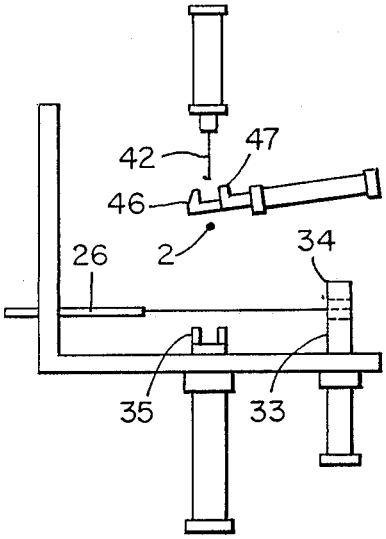

Referring first to needle threading, ram 24 is extended to move the thread aligner tube 26 to the position shown in broken lines in FIG. 7 where it passes between the jaws of the first thread clamp. The ram is retracted to withdraw the tube, the action of advancing the tube having been to ensure that the free end of the thread lies between the jaws 33, 34 of the clamp. That clamp is then closed as shown in FIG. 8 to secure the free end of the thread, and the thread lies in a first thread path extending from the free end 27 of the retracted tube to the first thread clamp 33, 34.

Figure 9:
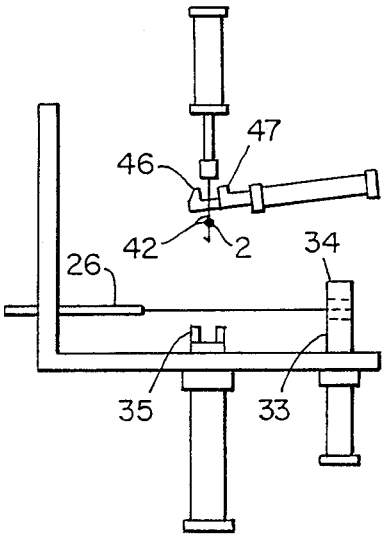
Figure 10:
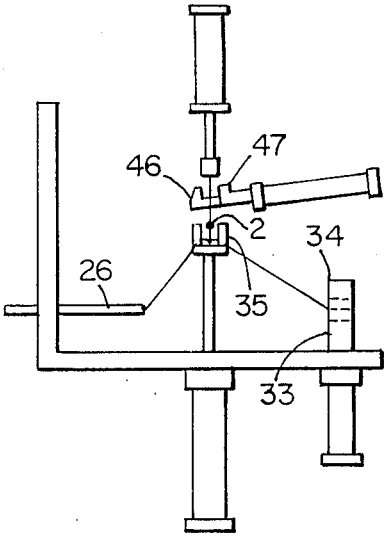
Figure 11:
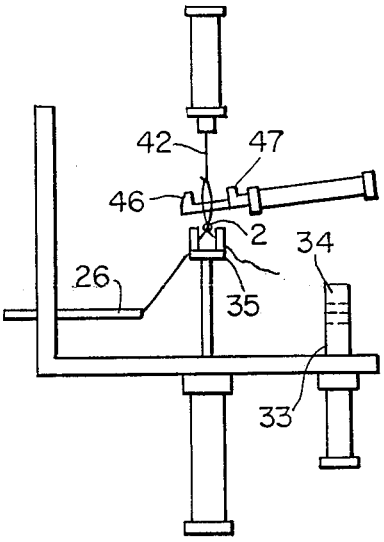

The hook 42 is then advanced from its retracted position through the needle, to its advanced position as shown in FIG. 9, and the thread pusher 35 is advanced to move the thread out of the first thread path so that it engages the hook. During this movement the free end of the thread is held in position by the first thread clamp 33, 34 and thread as necessary is pulled from the package through the thread aligner tube 26. The hook 42, carrying the thread, is retracted through the needle eye. This has the effect of threading a double length of thread through the needle eye as shown in FIG. 11, the thread passing between the jaws of the second thread clamp 46, 47. The second thread clamp is then retracted to the closed position, so releasing the thread from the hook and clamping it to the jaws of the second clamp. The thread pusher 35 is retracted, and the first thread clamp 33, 34 is opened to release the free end of the thread.

Figure 12:
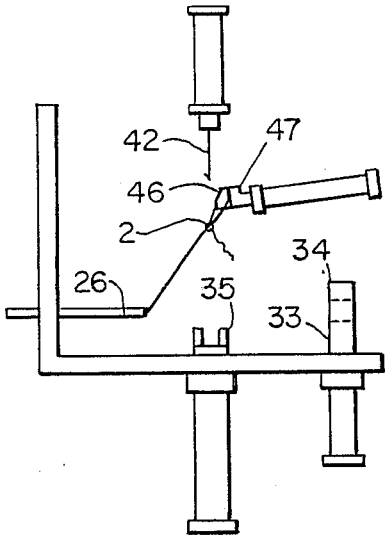
Figure 14:
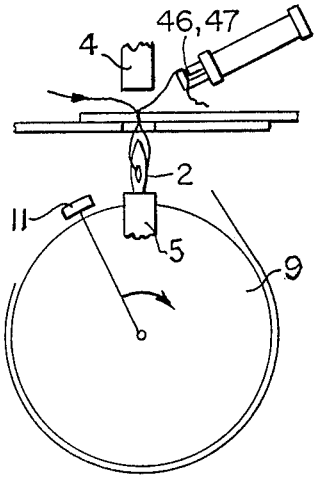
Figure 15:
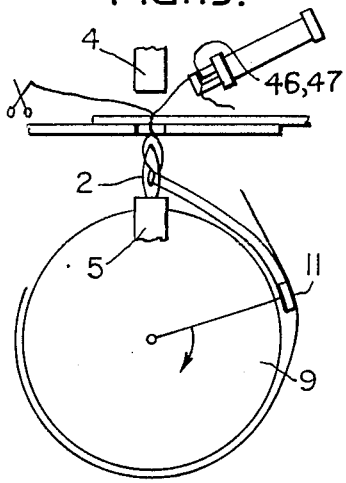
Figure 16:
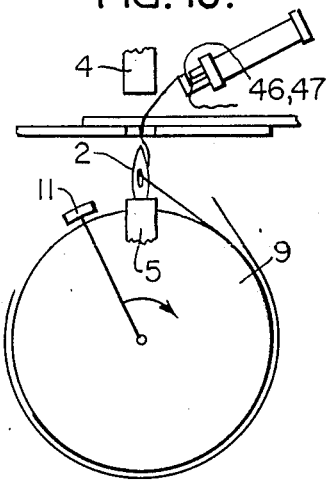
Figure 17:
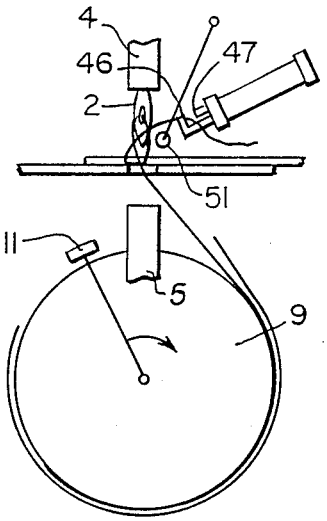
Figure 18:
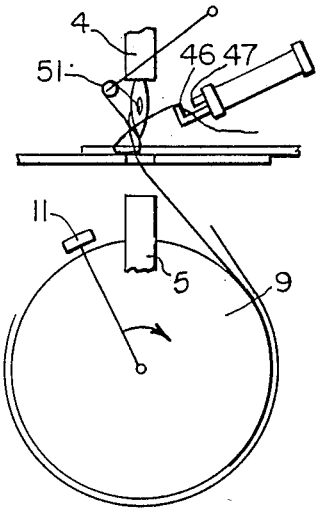

Turning now to FIGS. 13 to 18, the thread position shown in FIG. 12 is reproduced in FIG. 13, showing the needle 2 in the upper position and the thread looper 11 in its start position. The workpiece 50 is positioned below the needle and above the throat plate 8 and the machine is operated to move the needle to the lower position, the needle being transferred from the upper needle holder 4 to the lower needle holder 5 during such movement. The thread is held by the second thread clamp 46, 47, the free end of thread pulling out of the eye of the needle and the needle drawing thread as necessary from the package through the thread aligner tube 26. This position is shown in FIG. 14 and the looper 11 is then rotated clockwise round the drum, picking up the length of thread coming from the package and wrapping it partly around the periphery of the drum. The angle through which the looper travels will be dependent on the length of thread required for the particular stitching operation. When the looper has completed the necessary travel, the thread is cut by operation of the ram 110, so causing the thread coming from tube 26 to be cut between the knife edges 107 and 112. The other part of the thread coming from clamp 46, 47 is not cut in this operation due to its different alignment over the presser foot. The free end of the thread coming from the package is again caught by the air current and restored to the original thread path as shown in FIG. 8, ready for a subsequent operation. The looper 11 continues round the drum 9 to complete laying of the full length of cut thread around the drum periphery as shown in FIG. 16.

Once the thread has been fully wrapped, the workpiece is advanced by the conventional feed mechanism of the machine, and the needle is returned to the upper position, having thus formed one stitch through the workpiece. An upper looper 51 is then pivoted from the position shown in FIG. 17 to that shown in FIG. 18, so partially drawing thread from round the drum, as is again well known in the art. The workpiece is advanced and the needle is then moved back to the lower position and the main looper rotated clockwise to draw the thread through the stitch holes in the workpiece and lay it back onto the drum periphery. This is the stitching sequence, which is repeated as desired. After two or three stitches have been formed the clamp 46, 47 can be released. Once stitching has been completed, the machine is stopped with the needle up, the stitched workpiece withdrawn and the machine is then ready for a further operation.

It will be appreciated that the particular arrangement of the parts described may be changed. For example, in one arrangement the first clamp 33, 34 may be replaced or supplemented by a clamp capable of movement from its initial position in order to draw an extended length of thread from the thread package before or during the needle threading operation. Furthermore, the device may be used with any floating or latched needle needle machine, although the preferred machine is the AMF Model 70–52 floating needle machine manufactured by Automated Machinery Systems Inc.

I claim:

1. A sewing machine capable of simulating hand stitching, the machine comprising a throat plate, a needle passage region through the throat plate, a needle, means for driving the needle between a raised position lying wholly above the throat plate and a lowered position lying wholly below the throat plate, and thread-control means lying below the throat plate, and including above the throat plate thread-guide means for guiding supplied thread so that a section thereof lies in a first thread path, first clamp means operable to releasably clamp the thread adjacent to a free end thereof when lying in said first thread path, thread pick-up means, first drive means for moving the pick-up means, from a retracted position to an advanced, thread pick-up position, the pick-up means being cooperable with the raised needle so that during movement back to the retracted position the picked up thread engages and is held by the raised needle and part of the thread is caused to lie in a second thread path extending from the raised needle to the retracted pick-up means, and second clamp means operable to releasably clamp thread lying in the second thread path.

2. A sewing machine according to claim 1 in which the needle has an eye, the thread pick-up means is a hook, and the first drive means comprises means for driving the hook from the retracted position through the eye of the needle to the advanced position.

3. A sewing machine according to claim 2 and including means for engaging the thread with the hook when the hook is in or about the advanced position.

4. A sewing machine according to claim 3 in which the means for engaging the thread with the hook comprises thread pushing means and second drive means for moving the thread means between a retracted position and an advanced position, movement to the advanced position being across the first thread path to pick up thread and move it to a position engaged with the hook.

5. A sewing machine according to claim 1 in which the second clamp means comprises first and second jaws and third drive means for moving the first jaw across the second thread path from an open position to a closed position, such movement being effective to clamp the thread and to release the thread from the pick-up means.

6. A sewing machine according to claim 1 in which the thread guide means includes a straight guide tube extending towards the first clamp means, and means for blowing air through the tube so that an end section of thread passing through the tube is directed by the air stream to the region of the first clamp means.

7. A sewing machine according to claim 6 and including fourth drive means operable to advance the guide tube into jaws of the first clamp means and to retract it from those jaws.

8. A sewing machine according to claim 1 and further comprising thread cutting means.

9. A sewing machine according to claim 8 and including a presser foot located above the throat plate and having a needle passage opening therethrough, in which the thread cutting means is a blade movably mounted on the presser foot for movement across the needle passage opening, and fifth drive means for effecting movement of the blade.

10. A sewing machine according to claim 1 in which the first drive means and the first and second clamp means are pneumatically operated.

* * * * *